US009598984B2

(12) United States Patent
Bayrakdar et al.

(10) Patent No.: US 9,598,984 B2
(45) Date of Patent: Mar. 21, 2017

(54) CAMSHAFT ADJUSTING DEVICE

(71) Applicant: Schaeffler Technologies AG & Co. KG, Herzogenaurach (DE)

(72) Inventors: Ali Bayrakdar, Roethenbach/Pegnitz (DE); Joachim Dietz, Frensdorf (DE)

(73) Assignee: Schaeffler Technologies AG & CO. KG, Herzogenaurach (DE)

( * ) Notice: Subject to any disclaimer, the term of this patent is extended or adjusted under 35 U.S.C. 154(b) by 0 days.

(21) Appl. No.: 14/442,880

(22) PCT Filed: Sep. 9, 2013

(86) PCT No.: PCT/DE2013/200164
§ 371 (c)(1),
(2) Date: May 14, 2015

(87) PCT Pub. No.: WO2014/082626
PCT Pub. Date: Jun. 5, 2014

(65) Prior Publication Data

US 2015/0292367 A1 Oct. 15, 2015

(30) Foreign Application Priority Data

Nov. 29, 2012 (DE) ..... 10 2012 221 876

(51) Int. Cl.
*F01L 1/46* (2006.01)
*F01L 1/344* (2006.01)
*F01L 1/047* (2006.01)

(52) U.S. Cl.
CPC ..... *F01L 1/344* (2013.01); *F01L 1/3442* (2013.01); *F01L 2001/0476* (2013.01); *F01L 2001/34423* (2013.01)

(58) Field of Classification Search
CPC ..... F01L 2001/34423; F01L 2001/34426
(Continued)

(56) References Cited

U.S. PATENT DOCUMENTS 6,966,289 B1 11/2005 Butterfield
2004/0226526 A1* 11/2004 Palesch ..... F01L 1/022 123/90.17

(Continued)

FOREIGN PATENT DOCUMENTS

DE 10322394 12/2004
DE 103 46 443 5/2005

(Continued)

*Primary Examiner* — Jorge Leon, Jr.
(74) *Attorney, Agent, or Firm* — Davidson, Davidson & Kappel, LLC

(57) ABSTRACT

A camshaft adjusting device for an internal combustion engine including: a vane-type adjuster actuable by a pressure medium and which is rotationally fixed to a camshaft by a rotor and rotationally fixed to a crankshaft by a stator; a central valve has a displaceable valve body, by which a pressure medium is fed to the vane-type adjuster via a pump from a reservoir, the medium being selectively introduced into different working chambers and fed back from other working chambers to the reservoir, depending on the position of the valve body. The device includes a rolling bearing, by which the end section of the camshaft facing the vane-type adjuster is mounted in relation to a fixed housing wall. An axially oriented through-flow opening extends through the rolling bearing through which the pressure medium delivered by the pressure flows in an axial direction to the central valve.

6 Claims, 3 Drawing Sheets

(58) Field of Classification Search
USPC ..... 123/90.17
See application file for complete search history.

(56) References Cited

U.S. PATENT DOCUMENTS

| | | | | |
|---|---|---|---|---|
| 2005/0066924 | A1 | 3/2005 | Lehmann et al. | |
| 2008/0289592 | A1 | 11/2008 | Flender et al. | |
| 2011/0132303 | A1* | 6/2011 | Puetz | F01L 1/3442 123/90.17 |
| 2011/0139101 | A1* | 6/2011 | Dietz | F01L 1/047 123/90.15 |
| 2011/0192366 | A1* | 8/2011 | Gramkow | F01L 1/3442 123/90.17 |
| 2012/0012075 | A1 | 1/2012 | Schneider et al. | |
| 2012/0060787 | A1* | 3/2012 | Chang | F01L 1/34 123/188.4 |
| 2012/0199086 | A1* | 8/2012 | Hori | F01L 1/3442 123/90.17 |
| 2012/0210962 | A1 | 8/2012 | Hoppe et al. | |
| 2012/0255170 | A1 | 10/2012 | Flender et al. | |

FOREIGN PATENT DOCUMENTS

| | | |
|---|---|---|
| DE | 10 2008 039038 | 2/2010 |
| DE | 10 2009 009665 | 8/2010 |
| DE | 102009051310 | 5/2011 |
| DE | 10 2010 005 603 | 7/2011 |
| DE | 102010005603 | 7/2011 |
| EP | 1 995 417 | 11/2008 |
| WO | WO 2010/020507 | 2/2010 |

* cited by examiner

CAMSHAFT ADJUSTING DEVICE

The present invention relates to a camshaft adjusting device.

BACKGROUND

Camshaft adjusting devices are generally used in valve train assemblies of internal combustion engines to vary the valve opening and closing times, whereby the consumption values of the internal combustion engine and the operating behavior in general may be improved.

One specific embodiment of the camshaft adjusting device, which has been proven and tested in practice, includes a vane adjuster having a stator and a rotor, which delimit an annular space, which is divided into multiple working chambers by projections and vanes. A pressure medium may be optionally applied to the working chambers, which is supplied to the working chambers on one side of the vanes of the rotor from a pressure medium reservoir in a pressure medium circuit via a pressure medium pump, and which is fed back into the pressure medium reservoir from the working chambers on the particular other side of the vanes. The control of the pressure medium flow, and thus the adjusting movement of the camshaft adjusting device, takes place, e.g., with the aid of a central valve having a complex structure of flow-through openings and control edges, and a valve body, which is movable within the central valve and which closes or unblocks the flow-through openings as a function of its position. The valve body itself is spring-loaded with respect to the central valve and is displaced against the spring force with the aid of an adjacent piston of an actuator for adjusting the rotation angle of the rotor with respect to the stator. The rotor is generally connected to the camshaft, while the stator is driven by a crankshaft of the internal combustion engine, e.g., via a chain or a belt, so that the rotation angle of the camshaft with respect to the crankshaft is also adjusted by the adjustment of the rotor with respect to the stator.

In principle, the camshaft must be supported, which may take place via a rolling bearing, e.g., for the purpose of minimizing friction. A camshaft adjusting device of this type, which includes a rolling bearing, is known, e.g., from DE 10 2010 005 603 A1 or WO 2010/020507 A1. In these specific embodiments, the axial overall length and, in particular, the distance between the vane adjuster and the bearing, is significantly determined by the supply of the pressure medium via radial through-flow channels and annular channels in the camshaft, so that these specific embodiments may be implemented only if a certain installation space is available. Moreover, increased bearing forces and flexural torques in the camshaft result due to the distance between the vane adjuster and the bearing.

SUMMARY OF THE INVENTION

It is an object of the present invention to provide a camshaft adjusting device which includes a rolling bearing having a shortened axial overall length.

The present invention provides an axially oriented flow-through opening, extending through the rolling bearing, in the camshaft adjusting device, through which the pressure medium delivered by the pressure medium pump flows to the central valve in the axial direction. Due to the proposed approach, the axial overall length of the camshaft adjusting device may be significantly shortened, at least on the side of the rolling bearing, since the pressure medium, according to the approach according to the present invention, is introduced into the central valve through the rolling bearing instead of, as was previously common practice, through pressure medium channels provided between the vane adjuster and the rolling bearing or through pressure medium channels accessible from the outside in the end section of the central valve projecting out of the vane adjuster. Moreover, the vane adjuster may be situated much closer to the rolling bearing, so that the occurring bearing forces are lower, and the vane adjuster is better supported overall.

It is furthermore proposed that the central valve includes a central screw, with the aid of which the central valve is screwed into the camshaft, and the central screw has at least one axial flow-through opening, through which the pressure medium flows into the central valve. The central screw forms a kind of housing of the central valve and is additionally used to fasten the central valve in the camshaft adjusting device. The axial flow-through opening in the central screw forms the fluidic continuation of the flow channel formed by the flow-through opening in the camshaft. The flow-through opening is preferably situated in the front screw-in section of the central screw, with the aid of which the central screw is screwed into the camshaft.

In this case, a particularly favorable inflow of the pressure medium results if the flow-through opening in the camshaft and the flow-through opening in the central screw are situated coaxially with respect to each other, the central screw being screwed into the flow-through opening of the camshaft in another preferred specific embodiment in the sense of a simple structural design. The flow-through opening in the camshaft is thus used not only as a flow channel for the pressure medium but also to fasten the central valve.

In particular, the camshaft may be provided with a tubular design at least in the area of the flow-through opening, i.e., the through-flow opening is situated centrically in the camshaft. The camshaft may also be designed as a tube over its entire length, so that the pressure medium is also introduced into the camshaft as needed at the other end or at least at a great distance from the vane adjuster and the rolling bearing. Moreover, the camshaft may thereby be manufactured from a cost-effective semifinished product and with a low weight.

The axial overall length of the camshaft adjusting device in the area of the vane adjuster may be further shortened, in that the central valve extends through the rolling bearing.

It is furthermore proposed that a check valve is provided in the flow-through opening of the camshaft or the central valve, through which the pressure medium supplied by the pressure medium pump may be introduced into the central valve, and that a pressure limiting valve, which acts in parallel to the check valve, is provided, which allows the pressure medium to flow back to the pressure medium pump if a predetermined pressure in the pressure medium located in the central valve is exceeded.

BRIEF DESCRIPTION OF THE DRAWINGS

The present invention is explained in greater detail below on the basis of one preferred exemplary embodiment. Specifically.

DETAILED DESCRIPTION

Figure 1:
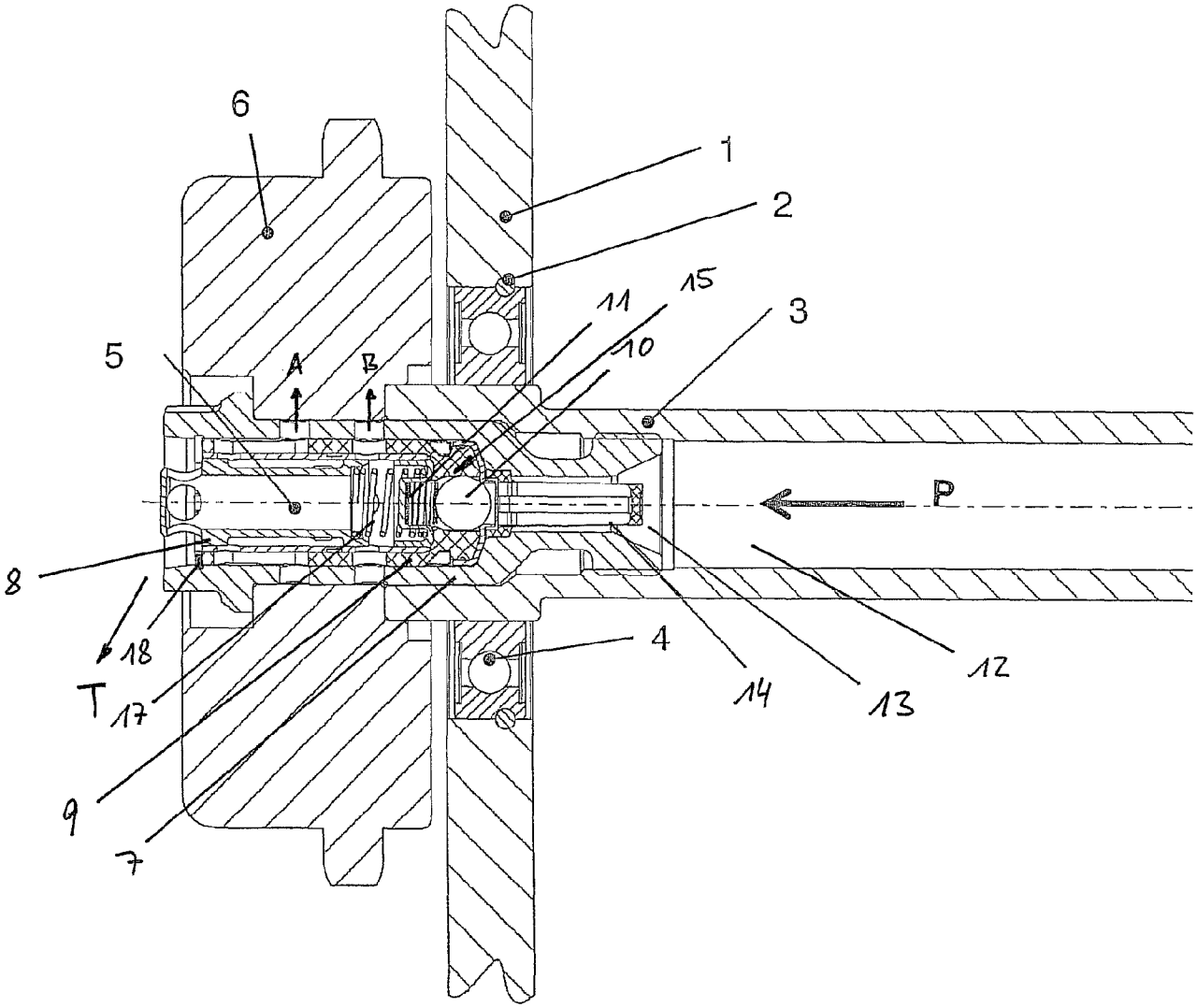
FIG. 1 shows a sectional representation of a camshaft adjusting device according to the present invention.

A camshaft adjusting device according to the present invention, including a vane adjuster 6, a central valve 5, a camshaft 3, a rolling bearing 4 and a housing wall 1, is apparent in FIG. 1. Housing wall 1 may be, e.g., the wall of a cylinder head or a cover of a cylinder head of an internal combustion engine, the important thing being only that housing wall 1 is a stationary wall. Vane adjuster 6 is illustrated schematically and includes a stator and a rotor, which are not illustrated. The stator has a cup-shaped design and is divided by the rotor into an annular space, which, in turn, is divided into multiple pressure chambers by stator webs provided on the stator and extending to the rotor. The pressure chambers are divided in the known manner into oppositely acting working chambers A and B by vanes provided on the rotor.

Central valve 5 includes a central screw 7, a valve insert 9 and a valve body 8, which is movable within valve insert 9 and which is supported on valve insert 9 via a spring 17 and is secured against sliding out by a retaining ring 18. Valve insert 9 and central screw 7 have a complex structure of pressure medium channels, control edges and pressure medium chambers, through which the pressure medium is optionally introduced into either working chambers A or working chambers B for the purpose of adjusting the rotation angle of camshaft 3 as a function of the position of valve body 8. Central valve 5 is screwed into tubular camshaft 3 with the aid of central screw 7, whereby the rotor, which is not illustrated, of vane adjuster 6 is simultaneously rotatably fixedly clamped to camshaft 3.

Camshaft 3 is provided with a tubular design having a central flow-through opening 12 and is rotatably supported in an opening of housing wall 1 via a rolling bearing 4. Rolling bearing 4 is nondisplaceably held in the opening of housing wall 1 with the aid of the outer ring via a retaining ring 2, while the inner ring of the rolling bearing rests against a bearing surface of camshaft 3 and is not secured laterally against a displacement, so that the bearing position may be viewed as a movable bearing.

An axially oriented flow-through opening 13 is also provided in the threaded neck of central screw 7, which is situated centrically in central screw 7 and coaxially to flow-through opening 12 of camshaft 3 in the screwed-in position of central valve 5. A check valve 15 having a mass body 10 and a spring 11 is furthermore provided in valve insert 9. Spring 11 pushes mass body 10 into a position which closes flow-through opening 13 in central valve 5, so that the pressure medium supplied by pressure medium pump P in the direction of the arrow is able to flow into central valve 5 only through flow-through opening 13 when the pressure in the pressure medium is sufficiently high to move mass body 10 against the spring force of spring 11 to the left in the illustration.

A filter 14 is furthermore provided in flow-through opening 13 of central screw 7, with the aid of which particles present in the pressure medium are filtered out. Upon an actuation of pressure medium pump P, the pressure medium flows in the direction of the arrow through flow-through openings 12 in camshaft 3 and through flow-through opening 13 in central screw 7 in the axial direction through rolling bearing 4, and it is introduced into either working chambers A or working chambers B in central valve 5 as a function of the position of valve body 8. By introducing the pressure medium into working chambers A or B, the rotor, together with camshaft 3, is rotated with respect to the stator and the crankshaft, the volume of working chambers A or B, into which the pressure medium is introduced, being increased, and the volume of particular other working chambers A or B being correspondingly decreased. By decreasing the volume of particular other working chambers A or B, the pressure medium is forced out of these working chambers A or B and fed back into a pressure medium reservoir T via central valve 5.

Due to the axial inflow of the pressure medium through tubular camshaft 3, vane adjuster 6 may be situated noticeably closer to rolling bearing 4 or housing wall 1, i.e., the axial overall length of the camshaft adjusting device to the left of housing wall 1, i.e., in this case the required installation space of the camshaft adjusting device outside the cylinder head, is significantly reduced. The axial distance between a toothed wheel or pulley and rolling bearing 4 provided on the stator is also shorter, so that the flexural torques in camshaft 3, which are active when driving the stator, and the resulting bearing forces in the area of the bearing position, are smaller. It is important that the pressure medium is introduced at a point in camshaft 3, which is situated on the other side of housing wall 1 than vane adjuster 6, i.e., to the right of housing wall 1 in the illustration. The axial overall length of the camshaft adjusting device to the left of housing wall 1, i.e., outside the cylinder head or the cylinder head cover, may therefore be shortened.

In the proposed specific embodiment, camshaft 3 is furthermore provided with a tubular design having a centric flow-through opening 12, so that the imbalance of camshaft 3 is preferably slight. If the flow-through opening extends over the entire length of camshaft 3, the pressure medium may also be introduced at the more remote end of camshaft 3. In the event that a tube is used to manufacture camshaft 3, camshaft 3 also does not have to be additionally machined, whereby the manufacturing costs may be further reduced.

Figure 2:
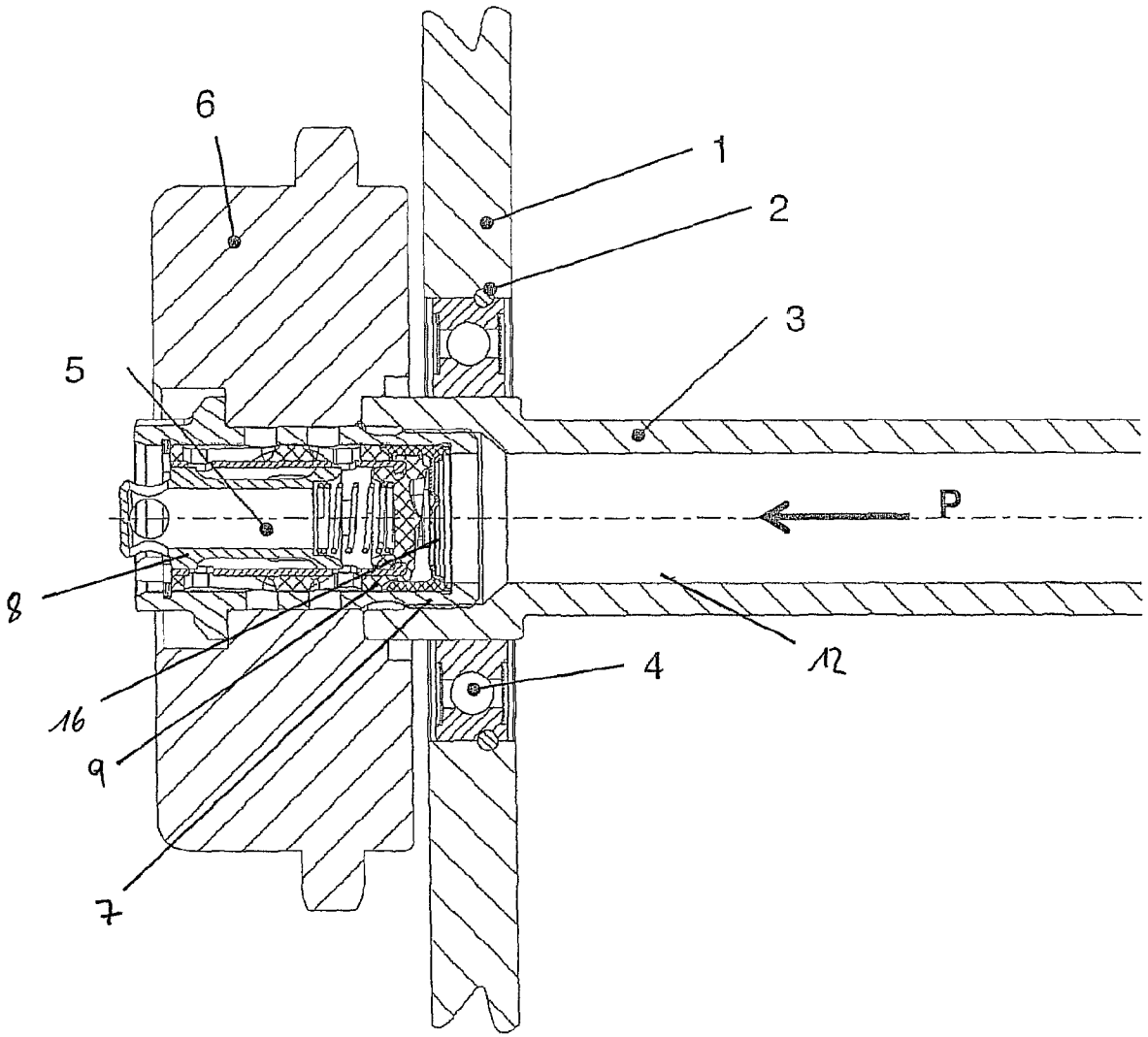
FIG. 2 shows a sectional representation of a camshaft adjusting device according to the present invention, including a pressure limiting valve.
Figure 3:
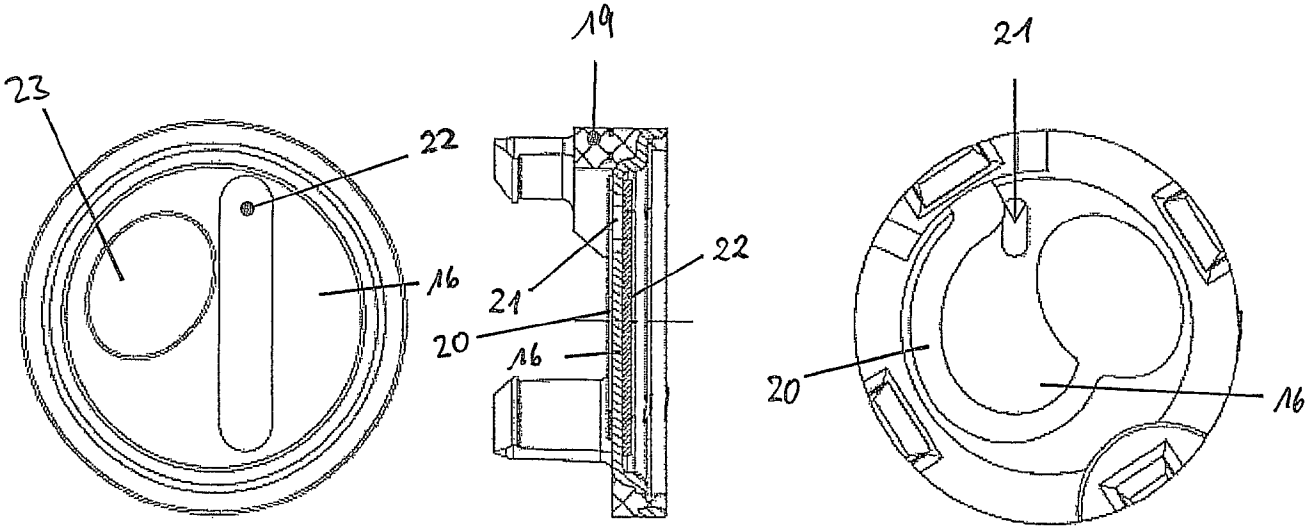
FIG. 3 shows an enlarged representation of a check valve, including a pressure limiting valve acting in parallel.

A refined camshaft adjusting device is apparent in FIG. 2, in which a check valve 16 having an additional, parallel-acting pressure limiting valve is provided in central valve 5, which is shown in an enlarged representation in FIG. 3.

Check valve 16 is situated in a plastic ring 19, which is clipped onto valve insert 9 with the aid of clamping arms. Check valve 16 is formed by a plate having an opening 23 and a spring steel sheet 20, which closes opening 23. Spring steel sheet 20 is situated on the side of the plate facing valve body 8 and is displaced in the direction of valve body 8, unblocking opening 23, by the pressure medium delivered by pressure medium pump P when a predetermined pressure is exceeded. A pressure limiting valve is furthermore provided in the form of a spring steel sheet 22 which closes an opening 21 and which is situated on the other side of the plate, i.e., on the inflow side of the plate. When the pressure of the pressure medium in central valve 5 or in vane adjuster 6 exceeds a predetermined pressure, e.g., during pressure peaks, spring steel sheet 22 is displaced in the direction of the inflow side of the pressure medium, so that the pressure medium is able to at least briefly flow back from central valve 5 into flow-through opening 12, and the pressure is reduced.

LIST OF REFERENCE NUMERALS

1 housing wall
2 retaining ring

3 camshaft
4 rolling bearing
5 central valve
6 vane adjuster
7 central screw
8 valve body
9 valve insert
10 mass body
11 spring
12 flow-through opening
13 flow-through opening
14 filter
15 check valve
16 check valve
17 spring
18 retaining ring
19 plastic ring
20 spring steel sheet
21 opening
22 spring steel sheet
23 opening

What is claimed is:

1. A camshaft adjusting device for an internal combustion engine comprising:

a pressure medium-actuatable vane adjuster rotatably fixedly connected to a camshaft via a rotor and is rotatably fixedly connected to a crankshaft of the internal combustion engine with the aid of a stator;

a central valve having a movable valve body, a pressure medium being supplied via the central valve from a pressure medium reservoir via a pressure medium pump and optionally introducable into different working chambers of the vane adjuster as a function of a position of the valve body and may be fed back into the pressure medium reservoir from other working chambers;

a rolling bearing, the camshaft via the rolling bearing being is supported against a stationary housing wall with the aid of its end section facing the vane adjuster;

an axially oriented flow-through opening extending through the rolling bearing, the pressure medium being delivered through the flow-through opening by the pressure medium pump flowing to the central valve in the axial direction; and a check valve in the flow-through opening, the flow through opening being in the camshaft or the central valve, and a pressure limiting valve acting in parallel to the check valve and permitting the pressure medium located in the central valve to flow back in the direction of the pressure medium pump when a predetermined pressure is exceeded.

2. The camshaft adjusting device as recited in claim 1 wherein the central valve includes a central screw, the central valve with the aid of the central screw being screwed into the camshaft; and the central screw including at least one axial screw flow-through opening, the pressure medium flowing into the central valve via the axial screw flow-through opening.

3. The camshaft adjusting device as recited in claim 2 wherein the flow-through opening is in the camshaft and the screw flow-through opening in the central screw is situated coaxially with the flow-through opening.

4. The camshaft adjusting device as recited in claim 2 wherein the central screw is screwed into the flow-through opening of the camshaft.

5. The camshaft adjusting device as recited in claim 1 wherein the camshaft is provided with a tubular design at least in the area of the flow-through opening.

6. The camshaft adjusting device as recited in claim 1 wherein the central valve extends through the rolling bearing.

* * * * *